US010883220B2

(12) United States Patent
Ryoo et al.

(10) Patent No.: US 10,883,220 B2
(45) Date of Patent: Jan. 5, 2021

(54) LAUNDRY MACHINE

(71) Applicant: LG ELECTRONICS INC., Seoul (KR)

(72) Inventors: Byeongjo Ryoo, Seoul (KR); Jaehyun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 971 days.

(21) Appl. No.: 14/905,492

(22) PCT Filed: Jul. 29, 2014

(86) PCT No.: PCT/KR2014/006926
§ 371 (c)(1),
(2) Date: Jan. 15, 2016

(87) PCT Pub. No.: WO2015/016571
PCT Pub. Date: Feb. 5, 2015

(65) Prior Publication Data

US 2016/0153135 A1 Jun. 2, 2016

(30) Foreign Application Priority Data

Aug. 1, 2013 (KR) ..... 10-2013-0091397

(51) Int. Cl.
*D06F 58/04* (2006.01)
*D06F 58/20* (2006.01)
(Continued)

(52) U.S. Cl.
CPC ..... *D06F 58/04* (2013.01); *D06F 58/206* (2013.01); *D06F 25/00* (2013.01); *D06F 58/02* (2013.01); *D06F 58/24* (2013.01)

(58) Field of Classification Search
CPC ..... D06F 58/206; D06F 58/04; D06F 58/24; D06F 43/086; D06F 58/20; D06F 58/00;
(Continued)

(56) References Cited

U.S. PATENT DOCUMENTS 4,603,489 A * 8/1986 Goldberg ..... F26B 21/086 34/77
9,212,450 B2 * 12/2015 Grunert ..... D06F 58/206
(Continued)

FOREIGN PATENT DOCUMENTS

CN 2679207 2/2005
CN 102108623 11/2011
(Continued)

OTHER PUBLICATIONS

International Search Report dated Dec. 1, 2014 issued in Application No. PCT/KR2014/006926.
(Continued)

*Primary Examiner* — Edelmira Bosques
*Assistant Examiner* — Bao D Nguyen
(74) *Attorney, Agent, or Firm* — KED & Associates LLP

(57) ABSTRACT

A laundry machine (100) is disclosed. The laundry machine (100) includes a cabinet (110) defining an exterior of the laundry machine (100), a tub (120) provided to the cabinet (110), a drum (150) rotatably provided in the tub (120), a suction duct (162) positioned on an outer circumferential surface of a rear portion of the tub (120) to suction air from the tub (120), a discharge duct (168) positioned at a front of the tub (120) to supply air to the tub (120), a connection duct (163) positioned between the suction duct (162) and the discharge duct (168), the connection duct (163) being provided with a heat exchanger (200, 300) for heating of the air,
(Continued)

and a circulation fan (167) positioned between the connection duct (163) and the discharge duct (168) to circulate the air.

7 Claims, 8 Drawing Sheets

(51) Int. Cl.
*D06F 25/00* (2006.01)
*D06F 58/24* (2006.01)
*D06F 58/02* (2006.01)

(58) Field of Classification Search
CPC ..... D06F 25/00; D06F 58/02; F25B 2400/05; F25B 2400/052; F25B 39/02; F25B 39/04; F28D 2021/0066; F28D 2021/007; F28D 2021/0071; F25D 2321/1412; F25D 2321/146
USPC ..... 34/108
See application file for complete search history.

(56) References Cited

U.S. PATENT DOCUMENTS 9,879,372 B2 * 1/2018 Wakizaka ..... D06F 58/30
2004/0079121 A1 * 4/2004 Yabuuchi ..... D06F 25/00 68/19.2
2005/0044744 A1 * 3/2005 Tadano ..... D06F 58/206 34/596
2005/0120577 A1 * 6/2005 Nakamoto ..... D06F 58/206 34/74
2005/0198852 A1 * 9/2005 Ono ..... D06F 58/206 34/77
2005/0204755 A1 * 9/2005 Nishiwaki ..... F26B 21/086 62/93
2005/0246920 A1 * 11/2005 Yabuuchi ..... D06F 58/02 34/515
2006/0048404 A1 * 3/2006 Tadano ..... D06F 58/24 34/134
2006/0053651 A1 * 3/2006 Tadano ..... D06F 58/206 34/74
2007/0163277 A1 * 7/2007 Tamura ..... F26B 21/086 62/160
2008/0235977 A1 * 10/2008 Kuwabara ..... D06F 58/206 34/77
2010/0077787 A1 * 4/2010 Masuda ..... F25B 49/022 62/324.5
2010/0170101 A1 * 7/2010 Taniguchi ..... D06F 58/30 34/132
2011/0265523 A1 * 11/2011 Bison ..... D06F 58/02 68/20
2012/0144693 A1 * 6/2012 Wakizaka ..... D06F 58/30 34/492
2012/0159972 A1 * 6/2012 Haryanto ..... F24F 13/222 62/78
2012/0167636 A1 * 7/2012 Nakamoto ..... D06F 58/30 68/19
2012/0186305 A1 * 7/2012 Taniguchi ..... D06F 25/00 68/19
2012/0210597 A1 * 8/2012 Bison ..... D06F 58/206 34/524
2012/0272689 A1 * 11/2012 Elger ..... D06F 58/206 68/20
2014/0020260 A1 * 1/2014 Carow ..... D06F 58/20 34/427
2014/0033563 A1 * 2/2014 Bison ..... F25B 40/00 34/524
2014/0109428 A1 * 4/2014 Kim ..... D06F 58/206 34/86
2014/0338218 A1 * 11/2014 Contarini ..... D06F 58/206 34/493
2014/0345155 A1 * 11/2014 Contarini ..... F26B 21/086 34/468
2015/0040421 A1 * 2/2015 Contarini ..... D06F 58/30 34/468
2015/0082658 A1 * 3/2015 Contarini ..... D06F 58/206 34/524

FOREIGN PATENT DOCUMENTS

DE 4409607 A1 10/1994
DE 102005014842 A1 5/2006
EP 2 055 427 A1 5/2009
EP 2 281 934 2/2011
EP 2 351 883 A2 8/2011
EP 2 612 963 7/2013
JP 2006-075217 3/2006
JP 2007-082831 4/2007
JP 2008086693 A * 4/2008
KR 10-2004-0034495 4/2004
KR 10-2012-0099073 9/2012

OTHER PUBLICATIONS

European Search Report dated Jan. 5, 2017 issued in Application No. 14832024.5.
Chinese Office Action dated Jul. 1, 23016 issued in Application No. 201480032004.6 (with English translation).
Korean Office Action dated Sep. 29, 2019 issued in KR Application No. 10-2013-0091397.

* cited by examiner

[Fig. 1]
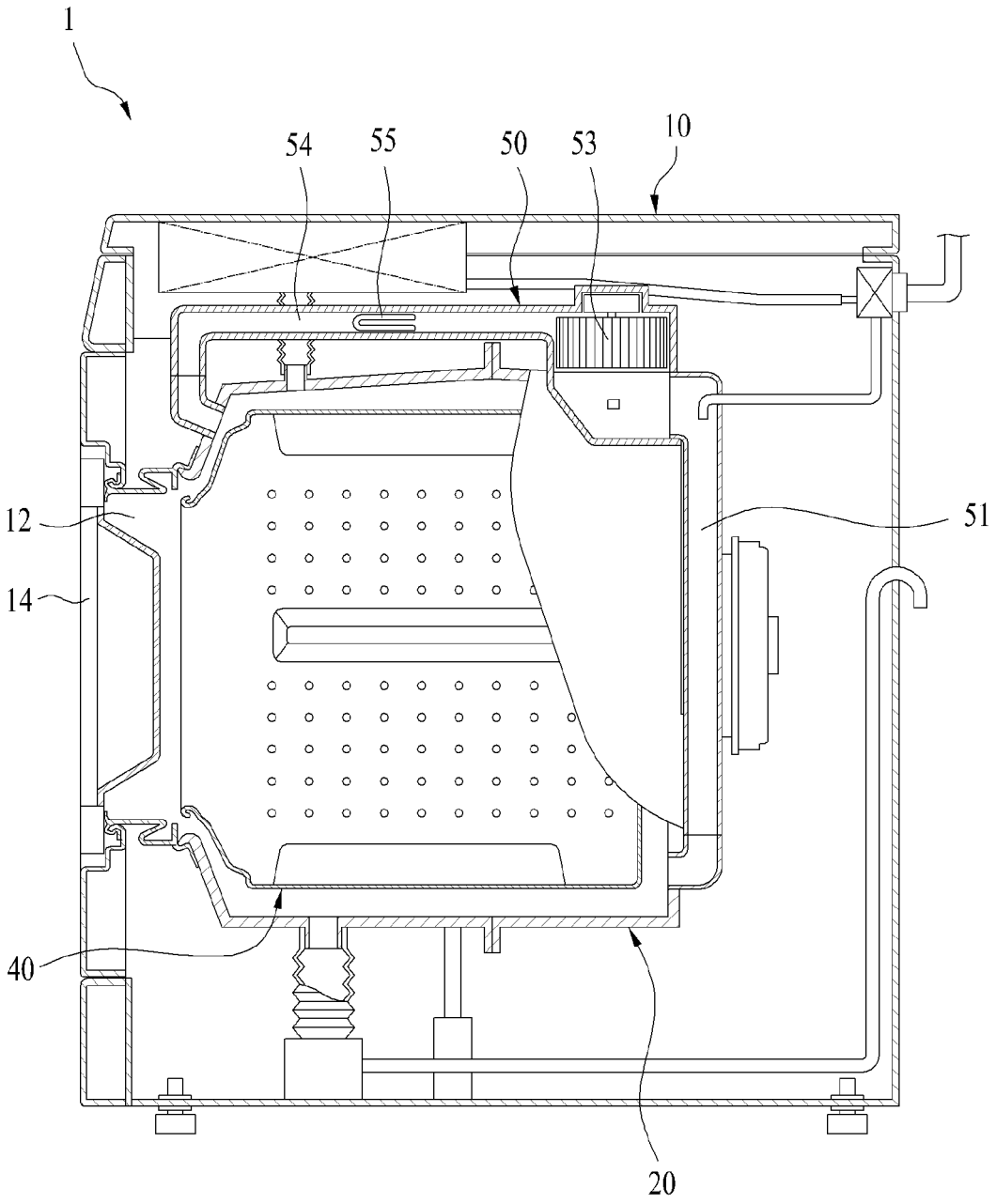

[Fig. 2]
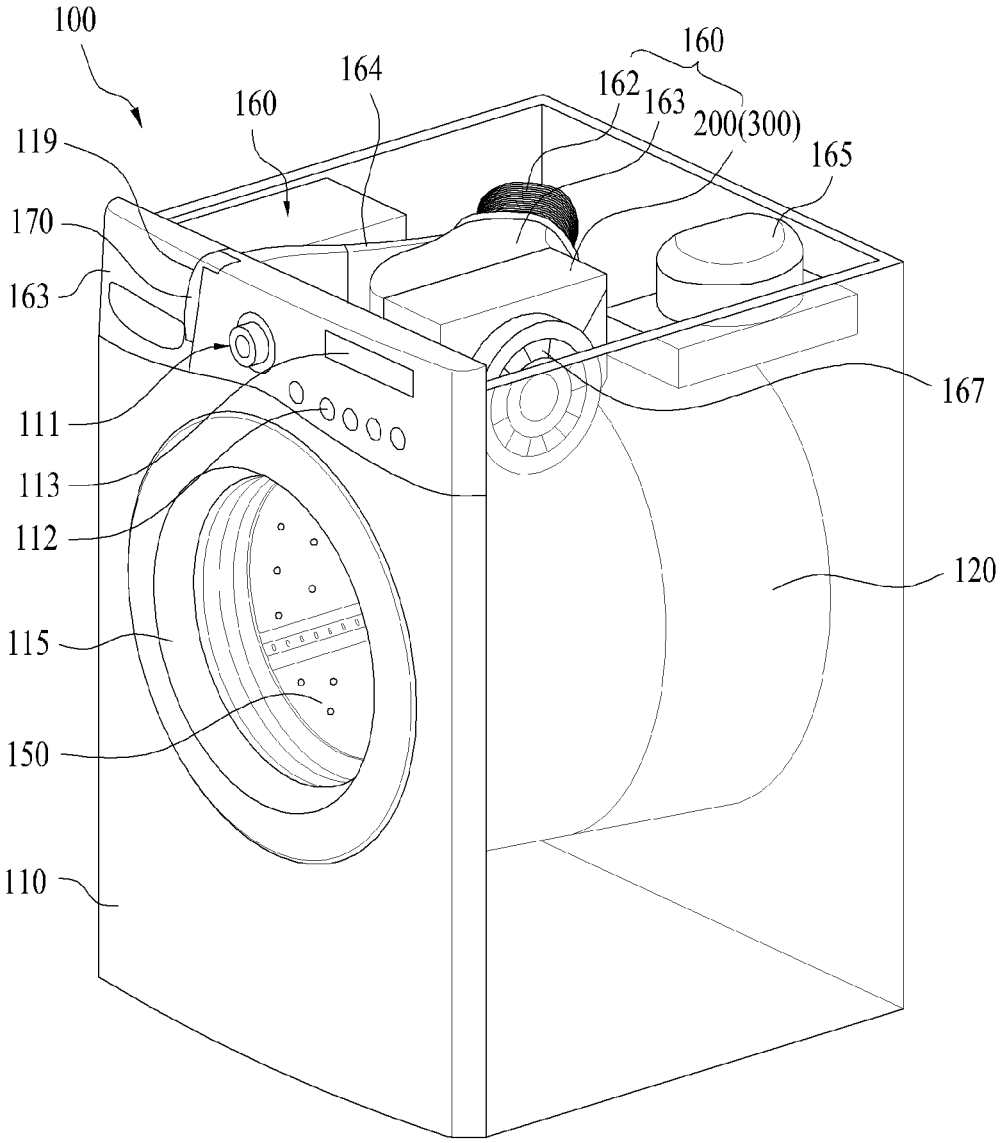

[Fig. 3]
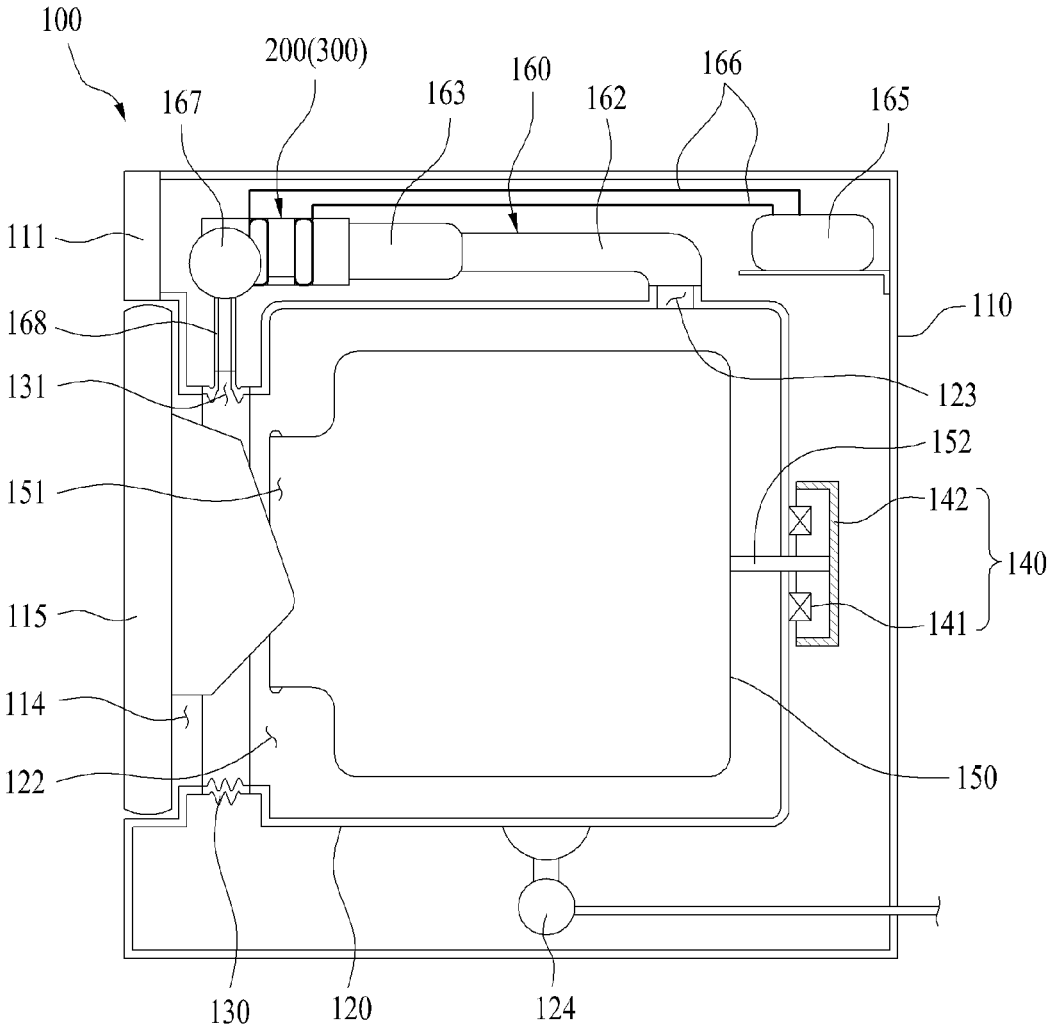

[Fig. 4]
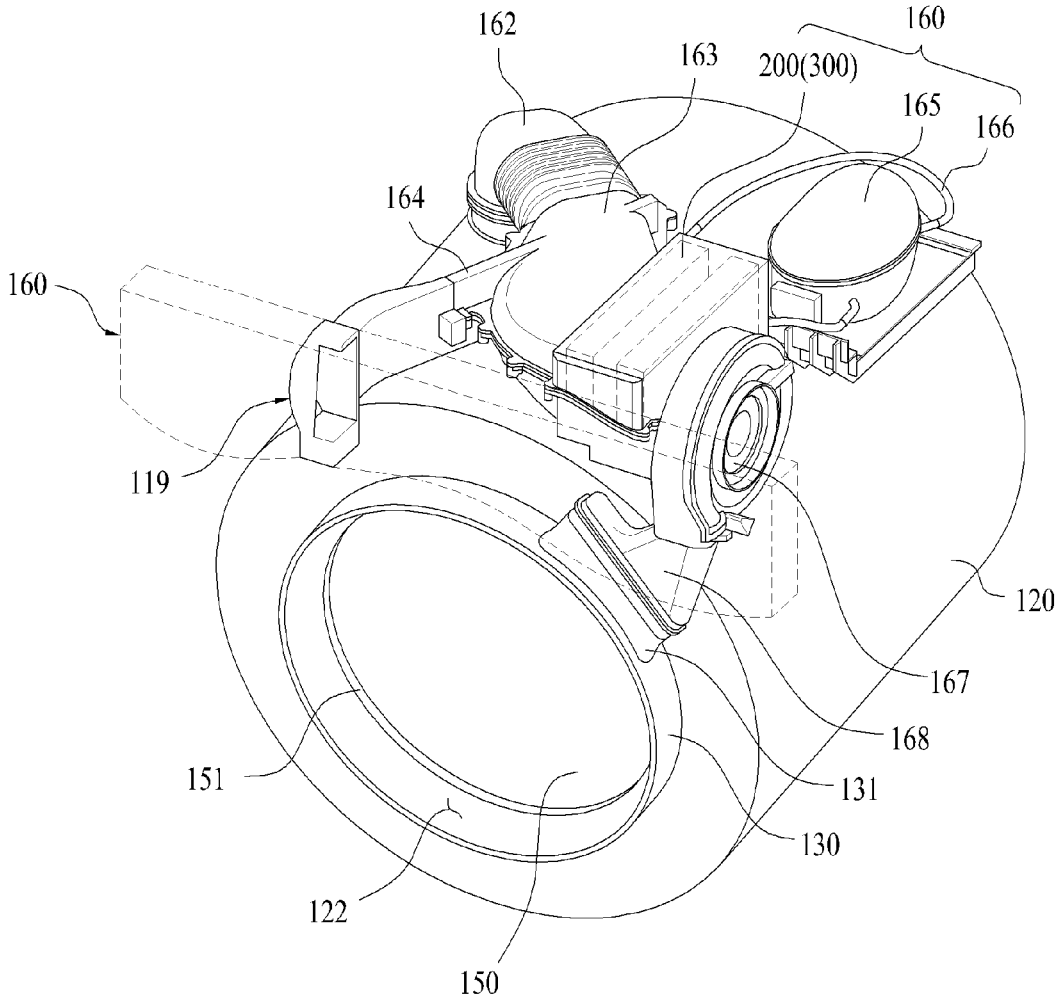

[Fig. 5]
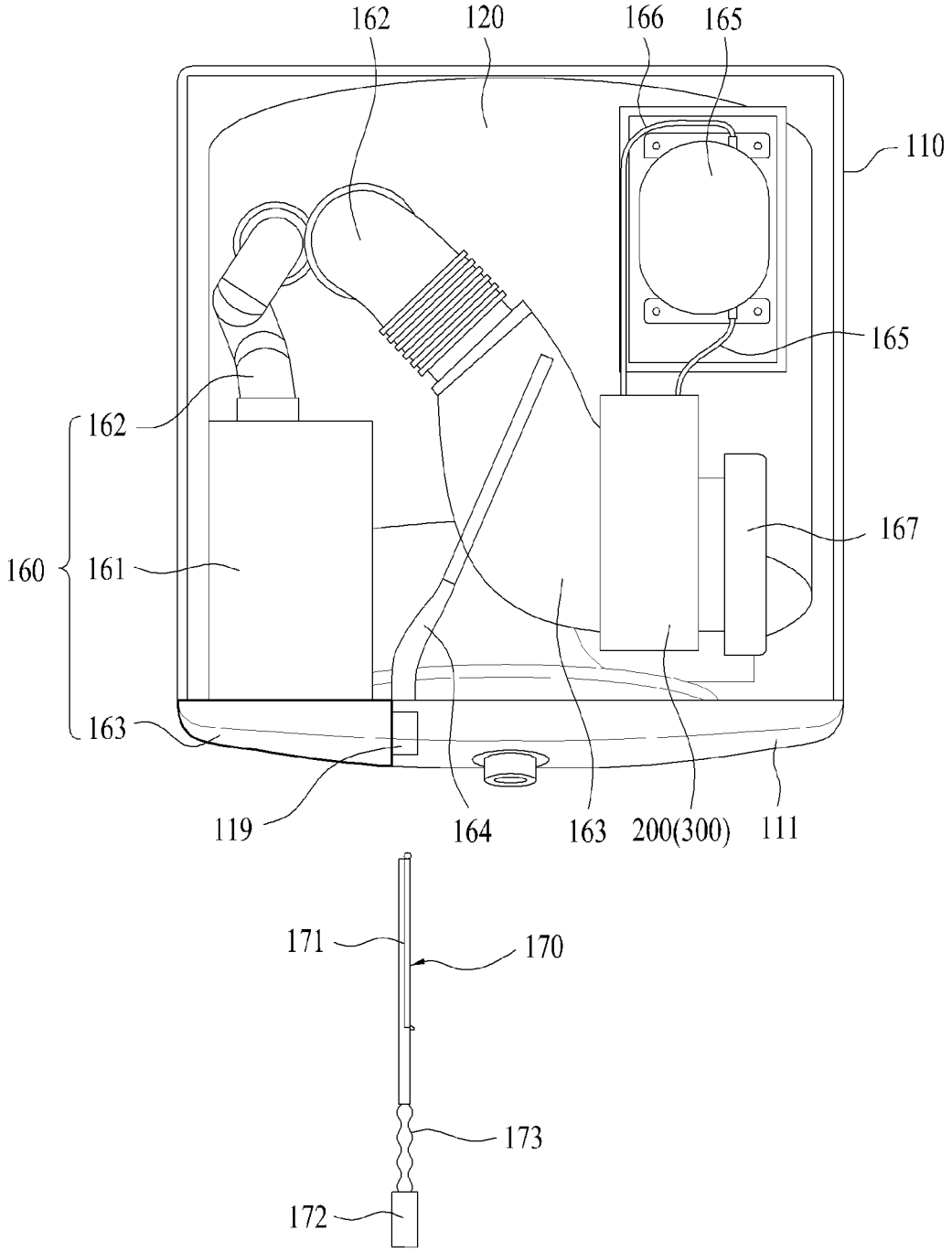

[Fig. 6]
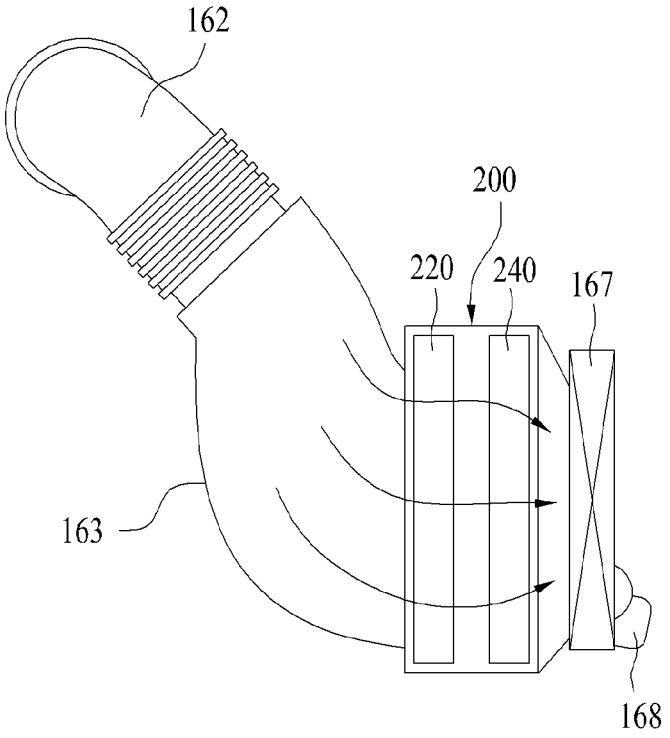

[Fig. 7]
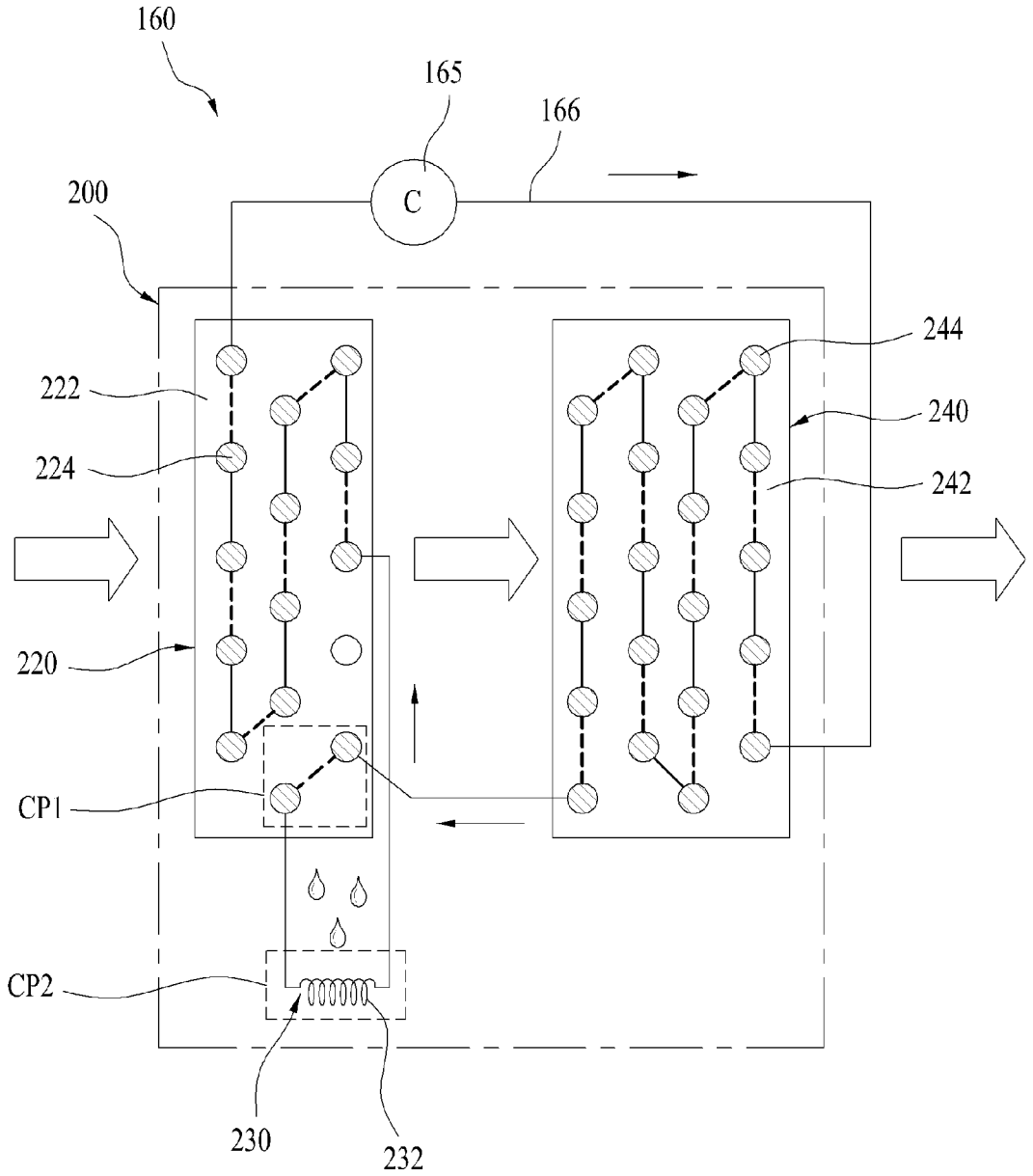

[Fig. 8]
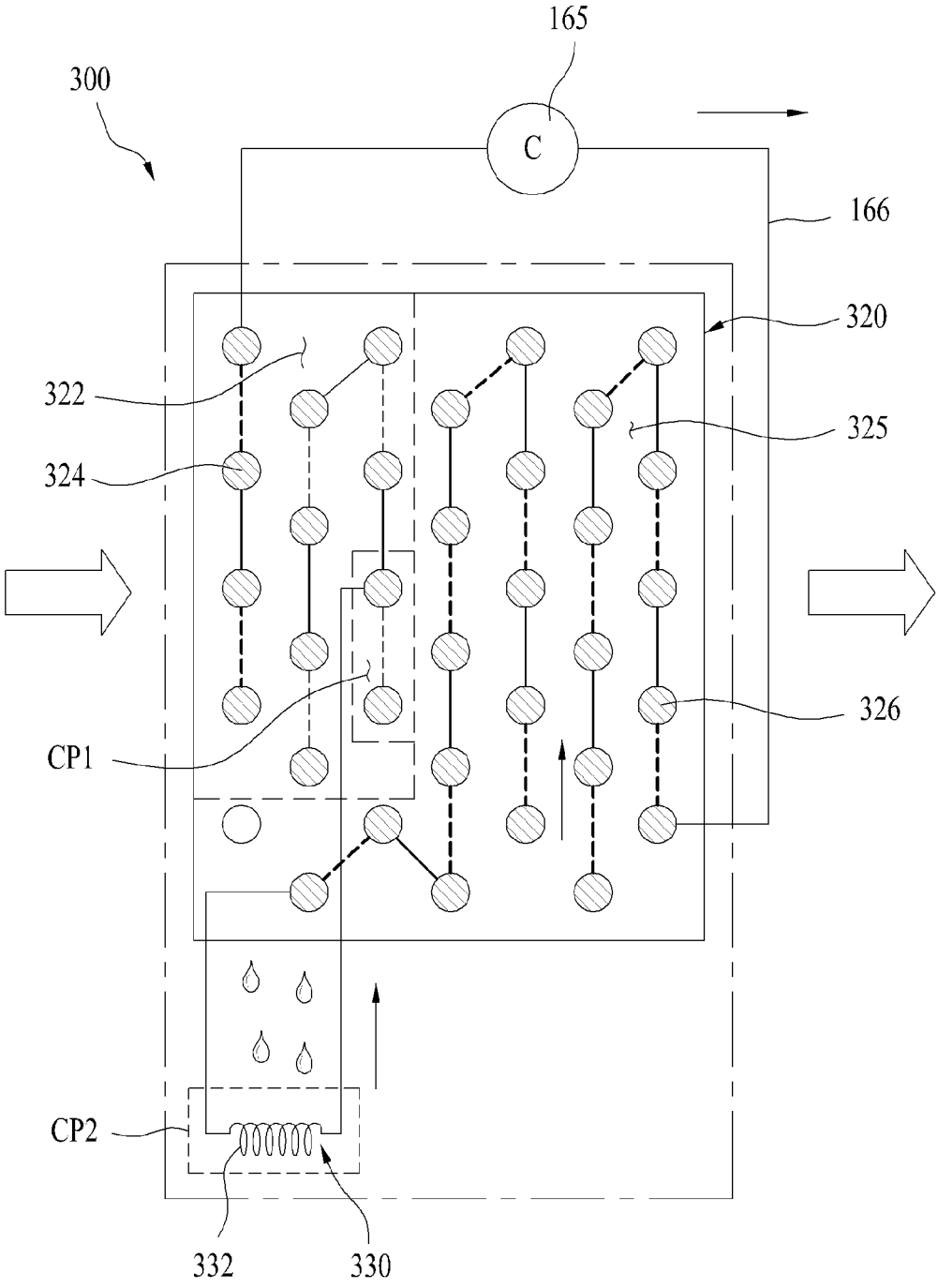

LAUNDRY MACHINE

CROSS-REFERENCE TO RELATED PATENT APPLICATIONS

This application is a U.S. National Stage Application under 35 U.S.C. § 371 of PCT Application No. PCT/KR2014/006926, filed Jul. 29, 2014, which claims priority to Korean Patent Application No. 10-2013-0091397, filed Aug. 1, 2013, whose entire disclosures are hereby incorporated by reference.

TECHNICAL FIELD

The present invention relates to a laundry machine. More specifically, the present invention relates to a laundry machine with a heat pump whose heat exchange efficiency is enhanced by improving the heat exchange structure.

BACKGROUND ART

Examples of laundry machines generally include a washing machine having only a washing function of washing clothing, and a machine having both washing and drying functions. The washing machine having only a washing function is a product that removes various contaminants from clothing and bedding using the softening effect of a detergent, friction of water streams and shock applied to the laundry to according to rotation of a pulsator or a drum. A recently introduced automatic washing machine automatically performs a series of operations including a washing operation, a rinsing operation and a spin-drying operation, without requiring user intervention.

The laundry machine capable of drying clothes is a type of laundry machines that has not only the function of the washing machine dedicated to washing but also the function of drying the laundry after washing.

Laundry machines capable of drying laundry supply high-temperature air (hot air) to the laundry, and can be classified into an exhaust type and a circulation (or condensation) type depending on how air flows through the machine.

The exhaust type laundry machine supplies heated air to the laundry accommodating part, but discharges the air coming out of the laundry accommodating part from the laundry machine instead of circulating the air.

The circulation type laundry machine circulates air in a laundry accommodating part storing the laundry by removing moisture from the air (i.e., dehumidifying the air) discharged from the laundry accommodating part, heating the air, and then re-supplying the air to the accommodation part.

Hereinafter, a conventional circulation type laundry machine having the drying function will be briefly described with reference to FIG. 1. As shown in FIG. 1, the circulation type laundry machine 1 having the drying function 1 includes a cabinet 10 provided with an introduction port 12 defining an accommodation space therein and allowing laundry to be introduced therethrough and an a door 14 to open and close the introduction port 12, a tub 20 to accommodate the cabinet 10, a drum 40 rotatably installed in the tub 20 to accommodate laundry to be dried, and an air supply unit 50 to supply the drying air to the tub 20 to dry the laundry.

Herein, the air supply unit 50 includes a condensation duct 51 formed at the exterior of the tub 20 to condense the air containing moisture produced in the tube 20, a heating duct 54 connected to the downstream side of the condensation duct 51 in the flow direction of the air to heat the air through a heater 56 and to supply the heated air into the tub, and an air-blowing fan 53 causing the air in the tub 20 to circulate along the condensation duct 51 and the heating duct 54.

In drying the laundry in the laundry machine 1 configured as above, the air moved by the air-blowing fan 53 is heated by the heater 56 provided to the heating duct 54, and the heated air is supplied into the tub 20. Thereby, the laundry is dried by rotation of the drum 40 and the hot air. Thereafter, the heated air having dried the laundry changes to humid air as the laundry is dried. The humid air flows from the tub 20 into the condensation duct 51, and the moisture is removed from the air in the condensation duct 51.

Herein, separate cooling water is supplied to the condensation duct 51 to condense the humid air. The air introduced into the condensation duct 51 is supplied back to the heating duct 54 by the air-blowing fan 53, thereby circulating through the process described above.

The condensation duct 51 is formed in the shape of a pipe in consideration of the volumetric capacity of the air-blowing fan 53 and smooth air flow, and the inner surface of the condensation duct 51 condenses moisture contained in the humid air through exchange of heat with the humid air to remove the moisture from the air. To condense the moisture in the humid air introduced into the condensation duct 51, a large amount of cooling water needs to be consistently supplied during the laundry drying process.

Meanwhile, the air supply unit 50 provided to the conventional laundry machine having the function of drying includes an air-blowing fan 53 to discharge the air from the laundry accommodating part and a heating duct 54 to heat the air caused to flow by the air-blowing fan 53.

That is, in the conventional laundry machine 1, the air-blowing fan 53 is positioned before the heating duct 54 with respect to the air flow direction, and thus the air flowing out of the laundry accommodation part (i.e., the tub 20) sequentially passes through the air-blowing fan 53 and heating duct 54, and is then supplied back to the laundry accommodation part.

The conventional laundry machine having the function of drying as described above is configured to consistently supply cooling water regardless of the user s section. That is, even when the user does not desire to use the cooling water, the cooling water is supplied. Accordingly, the undesired cooling water is inevitably used.

In addition, in the conventional laundry machine having the function of drying as described above, the air-blowing fan 53 is positioned at the front end of the heating duct 54. Thereby, the air moved by the air-blowing fan 53 may be concentrated only in a part of the entire section of the heater 56, and the efficiency of heat exchange in the heater 56 of the heating duct 54 may be lowered.

DISCLOSURE OF INVENTION

Technical Problem

An object of the present invention devised to solve the problem lies in a laundry machine provided with an air supply unit for supply of heated air for drying of laundry having an improved structure to increase drying efficiency.

Another object of the present invention devised to solve the problem lies in a laundry machine allowing the air moved by an air-blowing fan to pass through the entire heat exchange section of an air supply unit to increase heat exchange efficiency.

Another object of the present invention devised to solve the problem lies in a laundry machine having a heat exchanger with an improved structure provided to a drying duct of an air supply unit to increase heat exchange efficiency of the air passing through the drying duct and to simplify the structure of the heat exchanger.

Another object of the present invention devised to solve the problem lies in a laundry machine that improves the installation position of an air supply unit for supply of heated air to reduce the overall volume of the laundry machine such the laundry machine becomes compact.

Solution to Problem

The object of the present invention can be achieved by providing a laundry machine including a cabinet defining an exterior of the laundry machine, a tub provided to the cabinet, a drum rotatably provided in the tub, a suction duct positioned on an outer circumferential surface of a rear portion of the tub to suction air from the tub, a discharge duct positioned at a front of the tub to supply air from the tub, a connection duct positioned between the suction duct and the discharge duct, the connection duct being provided with a heat exchanger for heating of the air, and a circulation fan positioned between the connection duct and the discharge duct to circulate the air.

Preferably, the suction duct, the connection duct and the discharge duct are positioned at an upper portion of the tub.

Preferably, the heat exchanger is a heat pump to dehumidify and heat the air.

Preferably, the connection duct further includes a drainage means to drain condensed water produced by dehumidifying the air in the heat exchanger.

The heat exchanger preferably includes an evaporator configured to produce condensed water by dehumidifying the air, a condenser to heat the air having passed through the evaporator, an expansion valve connecting the condenser to the evaporator, the expansion valve being provided with a capillary tube, and a compressor provided to an exterior of the connection duct to circulate a refrigerant along the evaporator, the condenser and the expansion valve through a refrigerant pipe.

Preferably, the capillary tube of the expansion valve is positioned at a lower portion of the evaporator, and is cooled by the condensed water.

A part of the refrigerant pipe connecting the condenser and the evaporator is preferably connected to a lower portion of the evaporator.

Preferably, an area of the condenser is larger than an area of the evaporator.

The heat exchanger preferably includes a heat dissipation fin including an evaporation section to produce condensed water by dehumidifying the air and a condensation section to heat the air having passed through the evaporation section, an evaporation pipe passing through the evaporation section, a condensation pipe passing through the condensation section, an expansion valve connecting the condensation pipe and the evaporation pipe, the expansion valve being provided with a capillary tube, and a compressor provided to an exterior of the connection duct to circulate a refrigerant along the evaporation pipe, the condensation pipe and the expansion valve.

Preferably, the capillary tube of the expansion valve is positioned at a lower portion of the evaporation section, and is cooled by the condensed water.

Preferably, a part of the condensation pipe is connected to a lower portion of the evaporation section and then connected to the expansion valve.

Preferably, an area of the condensation section is larger than an area of the evaporation section.

Advantageous Effects of Invention

According to one embodiment of the present invention, a laundry machine using an air supply unit employing a heat pump may have a reduced volume and a compact size.

In addition, a laundry machine according to one embodiment of the present invention may improve the air supply structure and the air heating structure by using an air supply unit employing a heat pump.

In addition, in a laundry machine using an air supply unit employing a heat pump according to one embodiment of the present invention, the air movement path in a heat exchanger of the heat pump may be improved, thereby increasing heat exchange efficiency.

In addition, a laundry machine according to one embodiment of the present invention uses an air supply unit employing a heat pump and has a heat exchanger integrated with the air supply unit, thereby increasing the heat exchange efficiency of the heat exchanger.

BRIEF DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a cross-sectional view schematically illustrating the internal structure of a conventional laundry machine;

FIG. 2 is a perspective view illustrating a laundry machine according to the present invention;

FIG. 3 is a cross-sectional view schematically illustrating the internal structure of the laundry machine according to the present invention;

FIG. 4 is a perspective view illustrating main elements of the laundry machine according to the present invention;

FIG. 5 is a plan view illustrating main elements of the laundry machine according to the present invention;

FIG. 6 is a view schematically illustrating an air supply unit of the laundry machine according to the present invention;

FIG. 7 is a perspective view illustrating a heat exchanger according to one embodiment of the present invention; and FIG. 8 is a perspective view illustrating a heat exchanger according to another embodiment of the present invention.

BEST MODE FOR CARRYING OUT THE INVENTION

In describing the present invention, terms used herein for the elements are defined based on the functions of the elements. Accordingly, the terms should not be understood as limiting the technical elements. In addition, the terms for respective elements may be replaced with other terms used in the art.

Meanwhile, the construction and control method of an apparatus described below are simply illustrative of embodiments of the present invention, and are not intended to limit the scope of the present invention. Wherever possible, the same reference numbers will be used throughout the drawings to refer to the same or like parts.

In addition, the laundry mentioned in this specification includes not only clothes and costumes, but also objects such as shoes, socks, gloves, and hats which a person can wear. The laundry may treat all objects which can be washed.

Reference will now be made in detail to the preferred embodiments of the present invention, examples of which are illustrated in the accompanying drawings. FIG. 2 is a perspective view illustrating a laundry machine according to the present invention, and FIG. 3 is a cross-sectional view schematically illustrating the internal structure of the laundry machine according to the present invention.

As shown in FIGS. 2 and 3, the laundry machine 100 includes a cabinet 1 defining an external appearance of the laundry machine 100, a laundry accommodation part provided in the cabinet 110 to store laundry, and an air supply unit 160 to supply hot air to the laundry accommodation part.

The cabinet 110 includes an introduction port 114 for introduction of laundry and a door 115 rotatably provided to the cabinet 110 to open and close the introduction port 114. Provided to the upper portion of the introduction port 114 is a control panel 111 including at least one of an input unit 112 for input of a control command for operation of the laundry machine 100 and a display unit 113 to display details of control of the laundry machine.

Herein, the input unit 112 provided to the control panel 111 takes the form of a button or a rotary knob, and serves as a means to input, to a controller (not shown), control commands such as, for example, a program (a washing course or a drying course) for washing or drying set in the laundry machine, washing time, the amount of wash water, and hot air supply time.

The display unit 113 displays a control command (such as a course name) input through the input unit and information (such as remaining time) generated as the laundry machine 100 operates according to the input control command.

In the case in which the laundry machine 100 is provided as a dryer only for drying of laundry, the laundry accommodation part may be provided only with a drum 150 rotatably provided in the cabinet 110.

On the other hand, in the case in which the laundry machine 100 is provided as an apparatus capable of both washing and drying of the laundry, the laundry accommodation part may include a tub 120 provided in the cabinet to store wash water and a drum 150 rotatably provided in the tub to store the laundry, as shown in FIG. 2.

For simplicity of description, it will be assumed in the following description that the laundry accommodation part is provided with both the tub 120 and the drum 150.

As shown in FIG. 3, the tub 120 has the shape of a hollow cylinder and is supported on or fixed to the interior of the cabinet 110 by a separate suspension (not shown). In addition, the front of the tub 120 is provided with a tub opening 122 for introduction and retrieval of laundry at a position corresponding to the position of the introduction port 114 of the cabinet 110.

Herein, a gasket 130 is provided between the tub opening 122 and the introduction port 114. The gasket 130 not only serves to prevent the wash water stored in the tub 120 from leaking from the tub 120, but also serves to prevent vibration generated in the tub 120 during rotation of the drum 150 from being transferred to the cabinet 110. Accordingly, the gasket 130 may be provided with a vibration isolation material such as rubber.

Meanwhile, the tub 120 may be arranged parallel with the ground on which the cabinet 110 is placed as shown in FIG. 3, or may be inclined at a predetermined angle with respect to the ground. In the case in which the tub 120 is inclined at a predetermined angle with respect to the ground, the inclination angle of the tub 120 is preferably less than 90 degrees.

Herein, the upper circumferential portion of the tub 120 is provided with an air discharge hole 123 for discharge of air from the tub 120, and the lower portion of the tub 120 is provided with a drainage unit 124 to discharge the wash water stored in the tub 120.

In addition, the air discharge hole 123 is arranged in the longitudinal direction of the tub 120. Preferably, the air discharge hole 123 is spaced a predetermined distance from a line passing through the center of the tub 120.

Herein, the air discharge hole 123 is positioned so as to facilitate discharge of air from the tub 120 through the air discharge hole 123 when the drum 150 rotates.

The drum 150, which has the shape of a hollow cylinder, is positioned in the tub 120 and is rotated in the tub 120 by a motor 140 provided to the exterior of the tub 120.

Herein, the motor 140 may include a stator 141 fixed to the rear surface of the tub 120, a rotor 142 to rotate through electromagnetic interaction with the stator 141, and a rotating shaft 152 connecting the rear surface of the drum 150 and the rotor 142 by penetrating the rear surface of the tub 120.

The drum 150 is provided with a drum opening 151 communicating with the introduction port 114 and the tub opening 122, and accordingly the user can introduce laundry into the drum 150 through the introduction port 114 or take the laundry stored in the drum 150 out of the cabinet 110.

In the case in which the laundry machine 100 is capable of both washing and drying laundry, the interior of the cabinet 110 may be further provided with a detergent supply unit 180 to store a detergent to be supplied to the tub 120.

The detergent supply unit 180 may include a storage unit 181 (see FIG. 5) provided in the form of a drawer withdrawable from the cabinet 110, a detergent supply pipe 182 (see FIG. 5) to guide the detergent stored in the storage unit 181 into the tub 120, and a storage unit handle 183 positioned at one side of the control panel 111 to allow the user to withdraw the storage unit 181 from the cabinet 110.

The storage unit 181 receives water from a water supply source (not shown) arranged outside of the laundry machine 100. When water is supplied to the storage unit 181 through the water supply source, the detergent in the storage unit 181 and water are supplied together to the tub 120 through the detergent supply pipe 182.

The air supply unit 160 includes, as shown in FIG. 4, circulation flow passages 162, 163 and 168 to guide air discharged from the tub 120 to the front surface of the tub 120 (i.e., one surface of the tub formed on the side where the introduction port 114 is positioned), heat exchangers 200 and 300 provided in the circulation flow passages 162, 163 and 168, and an air-blowing fan 167 to circulate the air in the tub 120.

The circulation flow passages 162, 163 and 168 may be arranged such that the air discharged from the back of the tub 120 moves into the tub 120 through the front surfaced of the tub 120. FIG. 4 shows an example of the circulation flow passages 162, 163 and 168 allowing the air to be withdrawn from the upper rear portion of the circumferential surface of the tub 120 and to be discharged into the tub 120 through the upper front portion of the circumferential surface of the tub 120.

The circulation flow passages 162, 163 and 168 may include a suction duct 162 fixed to the air discharge hole 123 provided to the tub 120, a connection duct 163 connecting the suction duct 162 with the air-blowing fan 167 and allowing the heat exchangers 200 and 300 to be fixed thereto, and a discharge duct 168 connecting the air-blowing fan 167 with the gasket 130.

The suction duct 162 is a flow passage into which the air in the tub 120 is withdrawn through the air discharge hole 123 positioned at the rear portion of the circumferential surface of the tub 120. Preferably, the suction duct 162 is formed of a vibration isolation member (such as rubber, not shown). The vibration isolation member serves to prevent vibration transferred to the tub 120 during rotation of the drum 150 from being transferred to the connection duct 163 and the heat exchangers 200 and 300 through the suction duct 162.

To more efficiently prevent the vibration transferred to the tub 120 from being transferred to the connection duct 163 and the heat exchangers 200 and 300, the suction duct 162 may further be provided with a bellows. Herein, the bellows may be provided to the entire section of the suction duct 162, or may be provided to only a portion of the section of the suction duct 162 (e.g., a portion coupled to the connection duct 163).

The discharge duct 168 serves to guide the air discharged from the connection duct 163 through the air-blowing fan 167 into the tub 120. One end of the discharge duct 168 is fixed to the air-blowing fan 167, and the other end thereof is connected to a duct connection hole 131 provided to the gasket 130.

To prevent vibration transferred to the tub 120 from being transferred to the air-blowing fan 167 or the connection duct 163 through the discharge duct 168 during rotation of the drum 150, at least one of the gasket 130 and the discharge duct 168 is preferably formed of a vibration isolation member (or an elastic member).

Meanwhile, since the air-blowing fan 167 is provided between the heat exchangers 200 and 300 and the discharge duct 168, the air-blowing fan 167 allows the air to pass through the heat exchangers 200 and 300 by generating negative pressure at the back of the heat exchangers 200 and 300 rather than generating positive pressure at the front of the heat exchangers 200 and 300.

In the case in which the air-blowing fan 167 allows the air to pass through the heat exchangers 200 and 300 by generating positive pressure at the front of the heat exchangers 200 and 300, part of the air in the connection duct 163 may easily move to the heat exchangers 200 and 300, but the other part of the air may not easily move to the heat exchangers 200 and 300.

That is, most of the air discharged from the air-blowing fan 167 readily moves toward the heat exchangers 200 and 300, but a part of the air discharged from the air-blowing fan 167 may not rapidly move to the heat exchangers 200 and 300 depending on the shape of the connection duct 163 or the structure of the air-blowing fan.

Therefore, in the case of positioning the air-blowing fan 167 before the heat exchangers 200 and 300 to forcibly move the air toward the heat exchangers 200 and 300 (i.e., to create positive pressure at the front of the heat exchangers 200 and 300), the amount of air passing through a cross section of the connection duct 163 may vary depending upon the position of the connection duct 163, and accordingly heat exchange efficiency may be lowered.

On the contrary, the air-blowing fan 167 provided to the laundry machine 100 according to this embodiment is positioned between the heat exchangers 200 and 300 and the discharge duct 168 connected to the front surface of the tub (namely, the air sequentially passes through the heat exchangers 200 and 300 and the air-blowing fan 167), and therefore the aforementioned problem may be addressed.

As such, in the heat exchangers 200 and 300 of the present invention, the air-blowing fan is positioned between the heat exchangers 200 and 300 and the discharge duct 168 to generate negative pressure at the back of the heat exchangers 200 and 300, as shown in FIG. 6.

That is, when the negative pressure is generated at the back of the heat exchangers 200 and 300, the amount of air moving to the heat exchangers 200 and 300 along the connection duct 163 becomes constant throughout the entire cross sections of the connection duct 163. Thereby, the efficiency of heat exchange between air and the heat exchangers 200 and 300 is higher than in the case of positioning the air-blowing fan 167 at the front end of the heat exchangers 200 and 300, and thus the drying efficiency of the laundry machine may be increased.

Meanwhile, the air supply unit 160 may be provided to heat air through the heat pump to supply the heated air. In the case in which the air supply unit 160 is provided with a heat pump, the heat exchangers, evaporator, condenser of the heat pump are fixed to the interior of the connection duct 163, and the compressor 165 of the heat pump is provided to the exterior of the connection duct 163. The heat exchangers 200 and 300 which are main elements of the heat pump will be described in detail after description of the heat pump.

The circulation flow passages 162, 163 and 168 may be diagonally arranged with respect to the upper surface of the tub 120 as shown in FIGS. 4 to 5. In this case, the compressor 165 is preferably positioned in a space defined between the circulation flow passages 162, 163 and 168 and the cabinet 110 at the upper portion of the tub 120. Thereby, the space defined at the upper portion of the outer circumferential surface of the tub 120 may be efficiently utilized to prevent increase of the height or volume of the laundry machine 100.

The air supply unit 160 may further include a filter unit 170 configured to filter the air to prevent accumulation of foreign substances such as lint in the heat exchangers 200 and 300.

As shown in FIGS. 4 and 5, the filter unit 170 is preferably detachably attached to the connection duct 163 through the cabinet 110. To this end, the connection duct 163 is provided with a filter guide 164 to guide movement of the filter unit 170. The cabinet 110 may be provided with a filter mounting hole (not shown) allowing the filter unit 170 to pass therethrough.

In the case in which the laundry machine 100 is not provided with the detergent supply unit 180, a filter mounting part may be arranged to pass through the cabinet 110 or the control panel 111. In the case in which the laundry machine 100 is provided with the detergent supply unit 180, on the other hand, the filter mounting part may be positioned in a space between the detergent supply unit 180 (which is preferably positioned to be parallel with the control panel 111) and the control panel 111 such that it passes through the cabinet 110.

In addition, the filter mounting part is preferably provided to the upper portion of the laundry machine 100. This configuration allows the user to remove the filter unit 170 from the laundry machine 100 without bending over, contrary to the case in which the filter unit 170 is positioned at the lower portion of the laundry machine 100. Accordingly, this configuration may enhance user convenience.

The filter guide 164 is provided to connect the filter mounting part 119 to the connection duct 163 such that the filter unit 170 inserted into the filter mounting part 119 is positioned between the suction duct 162 and the heat exchangers 200 and 300.

The filter unit 170 includes a filter frame 171 provided with a filter and a handle 172 for withdrawal/introduction of the filter unit. The filter unit 170 may further include an elastic part provided between the filter frame 171 and the handle 172 and formed of an elastic member or elastic material to allow movement of the filter frame 171 relative to the handle. The elastic part 173 allows the filter frame 171 to be detachably mounted to the connection duct 163 in the case in which the filter mounting part and the connection duct 163 are not arranged parallel to a line perpendicular to the front surface of the cabinet 110.

Hereinafter, a detailed description will be given of the heat exchanger 200 of the air supply unit 160 according to one embodiment of the present invention with reference to FIG. 7.

The heat exchanger 200 of the air supply unit 160 heats and supplies air using the heat pump. The heat pump includes a compressor 165, a condenser 240, an expansion valve 230, and an evaporator 220. The air is heated by a refrigerant caused, by the compressor 165, to circulate along the compressor 165, the condenser 240, the expansion valve 230 and the evaporator 220.

Herein, the evaporator 220 and the condenser 240 are positioned in the connection duct 163. Meanwhile, the connection duct 163 having the evaporator 220 and the condenser 240 is positioned at the upper portion of the circumferential surface of the tub 120, and the evaporator 220 and the condenser 240 is arranged parallel with the axial direction of the tub 120 in the connection duct 163.

Accordingly, the space in which the evaporator 220 is positioned may have a different size than the space in which the condenser 240 is positioned due to a difference between the portions of the circumferential surface of the tub 120. That is, the position of a portion of the connection duct 163 to which the evaporator 220 is fixed may be lower than the position of another portion of the connection duct 163 to which the condenser 240 is fixed.

In the case in which the connection duct 163 formed in the longitudinal direction of the tub 120 has a constant width, and there is a difference in height between the spaces in which the evaporator 220 and the condenser 240 are placed, a heat exchange capacity of one of the evaporator 220 and the condenser 240 may limit the heat exchange capacity of the other one of the evaporator 220 and the condenser 240. To prevent this problem, an area ratio between the evaporator 220 and the condenser 240 is preferably set to be between 1:1.3 and 1:1.6.

Meanwhile, as shown in FIG. 7, the heat exchanger may include an evaporator 220, a condenser 240 and an expansion valve 230.

Herein, the evaporator 220 includes an evaporation pipe 224 through which the refrigerant moves, and a plurality of evaporation fins 222 provided to the outer circumferential surface of the evaporation pipe 224. The condenser 240 may include a condensation pipe 244 through which the refrigerant moves, and a plurality of condenser fins 242 provided to the outer circumferential surface of the condensation pipe 244.

Herein, the structures of the evaporator 220, condenser 240 and expansion valve 230 are similar to those of the general evaporator 220, condenser 240 and expansion valve 230, and thus a detailed description thereof will be omitted. In one embodiment of the present invention, the condensation pipe 244 of the condenser 240 is disposed differently from the expansion valve 230. Hereinafter, a detailed description will be given of disposition of the condensation pipe 244 of the condenser 240 and the expansion valve 230.

First, in the case of the condenser 240, the condensation pipe 244 to which the refrigerant is supplied from the compressor 165 is inserted into the condenser fins 242 in a zigzag pattern. In the case of the evaporator 220, the evaporation pipe 224 to which the refrigerant having passed through the condenser 240 moves is inserted into the evaporation fins 222 in a zigzag pattern.

In addition, the compressor 165, the condensation pipe 244, the expansion valve 230 and the evaporation pipe are connected by a refrigerant pipe 166 arranged therebetween to define a flow passage for the refrigerant. Herein, a part of the refrigerant pipe 166 placed between the condensation pipe 244 and the expansion valve 230 is connected to the expansion valve 230 by passing through the evaporator 220.

That is, formed at the evaporation fins 222 of the evaporator 220 is a primary cooling part CP1 into which the refrigerant pipe 166 placed between and connected to the condensation pipe 244 and the expansion valve 230 is inserted in a zigzag pattern. The primary cooling part CP1 is positioned at the lower portion of the evaporation fins 222 of the evaporator 220 to preliminarily cool the refrigerant moving from the condensation pipe 244 to the expansion valve 230 to increase latent heat of evaporation of the refrigerant moving from the expansion valve 230 to the evaporator 220.

Meanwhile, the refrigerant pipe 166 extending to the primary cooling part CP1 is connected to the expansion valve 230. The expansion valve 230 is provided with a capillary tube 232 to transform the refrigerant moving from the condenser 240 to the evaporator 220 into a low-temperature and low-pressure refrigerant. Herein, the capillary tube 232 of the expansion valve 230 is positioned at the lower portion of the evaporation fins 222 of the evaporator 220.

Meanwhile, humid air passing through the evaporator 220 is cooled according to phase change of the refrigerant, thereby producing condensed water at the evaporation fins 222 of the evaporator 220. The condensed water produced at the evaporation fins 222 moves down the evaporation fins 222 by gravity and falls to the capillary tube 232 of the expansion valve 230 at the lower portion of the evaporation fins 222, cooling the capillary tube 232. Herein, the portion of the capillary tube 232 cooled by the condensed water produced in the evaporator 220 is defined as a secondary cooling part CP2.

Herein, the expansion valve 230 is configured to transform the refrigerant moving to the evaporator 220 into a low-temperature and low-pressure refrigerant. Accordingly, the condensed water produced in the evaporator 220 further lowers the temperature of the capillary tube 232 by falling to the secondary cooling part CP2, and also lowers the temperature of the refrigerant passing through the capillary tube 232. Thereby, the latent heat of evaporation of the refrigerant moving to the evaporator 220 may be increased.

Meanwhile, the moisture in the air moving through the connection duct 163 is cooled and transformed into condensed water while passing through the evaporator 220. The condensed water cools the capillary tube 232 of the expansion valve 230 and remains in the connection duct 163.

If the condensed water remains in the connection duct 163, it may corrode elements in the connection duct 163, or may be mixed with the moving air and supplied to the laundry subjected to the drying operation. Accordingly, a means to discharge the residual condensed water in the connection duct 163 from the heat exchanger 200 may be further provided. The means to discharge the condensed water from the connection duct 163 may be embodied in various forms. An example of the means may be a drainage flow passage (not shown) connecting the heat exchanger 200 to the drainage unit 124 or the tub 120.

Hereinafter, a detailed description will be given of operation of a heat exchanger according to one embodiment of the present invention.

First, the compressor 165 of the heat pump provided to the air supply unit 160 is connected to the heat exchanger 200 via the refrigerant pipe 166, and the refrigerant is caused, by the compressor 165, to circulate along the condenser 240, the expansion valve 230 and the evaporator 220. At the same time, the air-blowing fan 167 of the air supply unit 160 operates to circulate the air in the tub 120 along a circulation flow passage (including the suction duct 162, the connection duct 163, the heat exchanger 200, and the discharge duct 168).

Herein, the refrigerant is compressed in the compressor 165 and then supplied to the condenser 240 of the heat exchanger 200 to heat the circulating air. After passing through the condenser 240, the refrigerant moves to the evaporator 220 to remove the moisture from the air in the evaporator 220.

In the movement path of the air, the evaporator 220 is positioned before the condenser 240. Accordingly, in the movement path of the air circulating along the tub 120 and the air supply unit 160, the moisture of the air suctioned from the tub 120 is first removed in the evaporator 220, and the dehumidified air is heated during movement through the condenser 240 and is then supplied back to the tub 120.

Herein, the refrigerant having been supplied to the condensation pipe 244 of the condenser 240 to heat the air moves to the primary cooling part CP1 formed in the evaporation fins 222 of the evaporator 220 through the refrigerant pipe 166 connected to the condensation pipe 244. The refrigerant having moved to the primary cooling part CP1 performs primary cooling according to the difference in temperature between the refrigerant and the evaporation fins 222, and then moves to the expansion valve 230 through the refrigerant pipe 166.

The refrigerant having moved to the expansion valve 230 is transformed into a high-temperature refrigerant while passing through the capillary tube 232 of the expansion valve 230, and then moves to the evaporation pipe 224 of the evaporator 220. Herein, the capillary tube 232 of the expansion valve 230 is positioned at the secondary cooling part CP2 formed at the lower portion of the evaporation fins 222 of the evaporator 220. The condensed water falling from the evaporation fins 222 to the secondary cooling part CP2 additionally cools the capillary tube 232 positioned at the secondary cooling part CP2. Therefore, the capillary tube 232 of the expansion valve 230 positioned at the secondary cooling part CP2 may supercool the refrigerant passing through the capillary tube, compared to the conventional cases.

Meanwhile, the refrigerant having passed through the expansion valve 230 moves to the evaporation pipe 224 of the evaporator 220, and evaporates in the evaporation pipe 224 by absorbing heat from the evaporation fins 222, cooling the evaporation fins 222 and condensing the moisture contained in the air passing through the evaporation fins 222 to transform the humid air into dry air.

Thereafter, the dry air may be heated while passing through the condenser 240, and then supplied to the tub 120 to dry objects to be dried.

As described above, in the case of the heat exchanger 200 according to one embodiment, the refrigerant moves to the primary cooling part CP1 of the evaporator 220 to be primarily cooled before moving to the expansion valve 230. Then, the refrigerant moves to the capillary tube 232 of the expansion valve 230 and is additionally cooled since the capillary tube 232 is positioned at the secondary cooling part CP2 formed at the lower portion of the evaporator 220. Thereby, the latent heat of evaporation of the refrigerant moving to the evaporator 220 may be increased, thereby enhancing the efficiency of the heat exchanger 200.

Hereinafter, the heat exchanger 300 of the air supply unit 160 according to another embodiment of the present invention will be described in detail with reference to FIG. 8.

As shown in FIG. 8, the heat exchanger 300 has an evaporator and a condenser which are integrated with each other to enhance productivity and thermal efficiency of the heat exchanger 300.

The heat exchanger 300 according to this embodiment includes a heat dissipation fin 320 divided into an evaporation section 322 performing the function of the evaporator and a condensation section 325 performing the function of the condenser, an evaporation pipe 324 inserted into the evaporation section 322 in a zigzag pattern, a condensation pipe 326 inserted into the condensation section 325 in a zigzag pattern, and an expansion valve 330 positioned at the lower portion of the evaporation section 322.

Herein, the heat dissipation fin 320 is divided into the evaporation section 322 and the condensation section 325 as described above, and a plurality of cutoff parts (not shown) may be formed between the evaporation section 322 and the condensation section 325 to decrease conductivity of heat between the evaporation section 322 and the condensation section 325.

According to this embodiment, the heat exchanger 300 of the air supply unit 160 heats and supplies the air using a heat pump. The heat pump includes a compressor 165, a heat exchanger 300 performing the functions of an evaporator and a condenser, and an expansion valve 330. As the refrigerant is circulated along the compressor 165, the heat exchanger 300, the expansion valve 330, and the heat exchanger 300, it heats the air.

Herein, the heat dissipation fin 320 provided with the evaporation section 322 and the condensation section 325 is positioned in the connection duct 163. Meanwhile, the connection duct 163 provided with the heat dissipation fin 320 is positioned at the upper portion of the tub 120, and the evaporation section 322 and condensation section 325 of the heat dissipation fin 320 are disposed in parallel with the axial direction of the tub 120 in the connection duct 163.

Accordingly, the space in which the evaporation section 322220 is positioned may have a different size than the space in which the condensation section 325 is positioned due to a difference between the portions of the circumferential surface of the tub 120. That is, the position of a portion of the connection duct 163 at which the evaporation section 322 is formed may be lower than the position of another portion of the connection duct 163 at which the condensation section 325 is formed.

Herein, in the case in which the connection duct 163 formed in the longitudinal direction of the tub 120 has a constant width, and there is a difference in height between the spaces in which the evaporation section 322 and the condensation section 325 are provided, a heat exchange capacity of one of the evaporation section 322 and the condensation section 325 may limit the heat exchange capacity of the other one of the evaporation section 322 and the condensation section 325. To prevent this problem, an area ratio between the evaporation section 322 and the condensation section 325 provided to the heat dissipation fin 320 is preferably set to between 1:1.3 and 1:1.6.

Meanwhile, the condensation pipe 326 to which the refrigerate is supplied from the compressor 165 is inserted into the condensation section 325 in a zigzag pattern, and the evaporation pipe 324 to which the refrigerant having passed through the condensation section 325 moves is inserted into the evaporation section 322 in a zigzag pattern.

In addition, the compressor 165, the condensation pipe 326, the expansion valve 330, and the evaporation pipe 324 are connected by a refrigerant pipe 166 arranged therebetween to define a flow passage for the refrigerant. Herein, a part of the refrigerant pipe 166 placed between the condensation pipe 326 and the expansion valve 330 is connected to the expansion valve 330 by passing through the evaporation section 322.

The refrigerant pipe 166 placed between and connected to the condensation pipe 326 and the expansion valve 330 is inserted into one side of the lower portion of the evaporation section in a zigzag pattern, defining a primary cooling part CP1. The primary cooling part CP1 preliminarily cools the refrigerant moving from the condensation pipe 326 to the expansion valve 330 to increase latent heat of evaporation of the refrigerant moving from the expansion valve 330 to the evaporation section 322.

Meanwhile, the refrigerant pipe 166 extending to the primary cooling part CP1 is connected to the expansion valve 330. The expansion valve 330 is provided with a capillary tube 332 to transform the refrigerant moving from the condensation section 325 to the evaporation section 322 into a low-temperature and low-pressure refrigerant. Herein, the capillary tube 332 of the expansion valve 330 is positioned at the lower portion of the evaporation section 322.

Meanwhile, humid air passing through the evaporation section 322 is cooled according to phase change of the refrigerant, thereby producing condensed water in the evaporation section 322. The condensed water produced in the evaporation section 322 moves down the evaporation section 322 by gravity and falls to the capillary tube 332 of the expansion valve 330 at the lower portion of the evaporation section 322, cooling the capillary tube 332. Herein, the portion of the capillary tube 332 cooled by the condensed water produced in the evaporation section 322 is defined as a secondary cooling part CP2.

Herein, the expansion valve 330 is configured to transform the refrigerant moving to the evaporation section 322 into a low-temperature and low-pressure refrigerant. Accordingly, the condensed water produced in the evaporation section 322 further lowers the temperature of the capillary tube 332 by falling to the secondary cooling part CP2, and also lowers the temperature of the refrigerant passing through the capillary tube 332. Thereby, the latent heat of evaporation of the refrigerant moving to the evaporation section 322 may be increased.

Meanwhile, the moisture in the air moving through the connection duct 163 is cooled and transformed into condensed water while passing through the evaporation section 322. The condensed water cools the capillary tube 332 of the expansion valve 330 and remains in the connection duct 163.

If the condensed water remains in the connection duct 163, it may corrode elements in the connection duct 163, or may be mixed with the moving air and supplied to the laundry subjected to the drying operation. Accordingly, a means to discharge the residual condensed water in the connection duct 163 from the heat exchanger 200 may be further provided. The means to discharge the condensed water from the connection duct 163 may be embodied in various forms. An example of the means may be a drainage flow passage (not shown) connecting the connection duct 163 to the drainage unit 124 or the tub 120.

Hereinafter, a detailed description will be given of operation of a heat exchanger according to another embodiment of the present invention.

First, the compressor 165 of the heat pump provided to the air supply unit 160 is connected to the heat exchanger 300 via the refrigerant pipe 166, and the refrigerant is caused, by the compressor 165, to circulate along the condensation section 325, the expansion valve 330, and the evaporation section 322. At the same time, the air-blowing fan 167 of the air supply unit 160 operates to circulate the air in the tub 120 along a circulation flow passage (including the suction duct 162, the connection duct 163, the heat exchanger 300 (specifically, the condensation section 325 and the evaporation section 322), and the discharge duct 168).

Herein, the refrigerant is compressed in the compressor 165 and then supplied to the condensation section 325 of the heat dissipation fin 320 to heat the circulating air. After passing through the condensation section 325, the refrigerant moves to the evaporation section 322 to remove the moisture from the air in the evaporation section 322.

In the movement path of the air, the evaporation section 322 is positioned before the condensation section 325. Accordingly, in the movement path of the air circulating along the tub 120 and the air supply unit 160, the moisture of the air suctioned from the tub 120 is first removed in the evaporation section 322, and the dehumidified air is heated during movement through the condensation section 325 and is then supplied back to the tub 120.

Herein, the refrigerant supplied to the condensation pipe 326 of the condensation section 325 to heat the air moves to the primary cooling part CP1 in the evaporation section 322 through the refrigerant pipe 166 connected to the condensation pipe 326. The refrigerant having moved to the primary cooling part CP1 performs primary cooling according to the difference in temperature between the refrigerant and the evaporation section 322, and then moves to the expansion valve 330 through the refrigerant pipe 166.

The refrigerant having moved to the expansion valve 230 is transformed into a high-temperature refrigerant while passing through the capillary tube 332 of the expansion valve 330, and then moves to the evaporation pipe 324 of the evaporation section 322. Herein, the capillary tube 332 of the expansion valve 330 is positioned at the secondary cooling part CP2 formed at the lower portion of the evaporation section 322. The condensed water falling from the evaporation section 322 to the secondary cooling part CP2 additionally cools the capillary tube 332 positioned at the secondary cooling part CP2. Therefore, the capillary tube 332 of the expansion valve 330 positioned at the secondary cooling part CP2 may supercool the refrigerant passing therethrough, compared to the conventional capillary tube 332.

Meanwhile, the refrigerant having passed through the expansion valve 330 moves to the evaporation pipe 324 of the evaporation section 322, and evaporates in the evaporation pipe 324 by absorbing heat from the evaporation section 322, cooling the evaporation section 322 and condensing the moisture contained in the air passing through the evaporation section 322 to transform the humid air into dry air.

Thereafter, the dry air may be heated while passing through the condensation section 325, and then supplied to the tub 120 to dry objects to be dried.

As described above, in the case of the heat exchanger 300 according to one embodiment, the refrigerant moves to the primary cooling part CP1 of the evaporation section 322 to be primarily cooled before moving to the expansion valve 330. Then, the refrigerant moves to the capillary tube 332 of the expansion valve 330 and is additionally cooled since the capillary tube 332 is positioned at the secondary cooling part CP2 formed at the lower portion of the evaporation section 322. Thereby, the latent heat of evaporation of the refrigerant moving to the evaporation section 322 may be increased, thereby enhancing the efficiency of the heat exchanger 300.

Various embodiments have been described in the best mode for carrying out the invention.

INDUSTRIAL APPLICABILITY

According to one embodiment of the present invention, a laundry machine using an air supply unit employing a heat pump may have a reduced volume and a compact size.

In addition, a laundry machine according to one embodiment of the present invention may improve the air supply structure and the air heating structure by using an air supply unit employing a heat pump.

In addition, in a laundry machine using an air supply unit employing a heat pump according to one embodiment of the present invention, the air movement path in a heat exchanger of the heat pump may be improved, thereby increasing heat exchange efficiency.

In addition, a laundry machine according to one embodiment of the present invention uses an air supply unit employing a heat pump and has a heat exchanger integrated with the air supply unit, thereby increasing the heat exchange efficiency of the heat exchanger.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundry machine comprising:

a cabinet defining an exterior of the laundry machine;

a tub provided to the cabinet;

a drum rotatably provided in the tub;

a suction duct positioned on an outer circumferential surface of a rear portion of the tub to suction air from the tub;

a discharge duct positioned at a front of the tub to supply air from the tub;

a connection duct positioned between the suction duct and the discharge duct, the connection duct being provided with a heat exchanger for heating of the air; and a circulation fan positioned between the connection duct and the discharge duct to circulate the air, wherein the heat exchanger comprises:

an evaporator configured to produce condensed water at evaporation fins by dehumidifying the air;

a condenser to heat the air having passed through the evaporator;

an expansion valve connecting the condenser to the evaporator, the expansion valve including a capillary tube positioned at a lower portion of the evaporator; and a compressor provided to an exterior of the connection duct to circulate a refrigerant through the evaporator, the condenser, and the expansion valve through a refrigerant pipe, wherein the refrigerant exiting the condenser enters a first portion of the evaporator, exits the first portion of the evaporator, and enters a second portion of the evaporator, wherein the first portion of the evaporator is positioned at a lower portion of a plurality of evaporation fins of the evaporator, and the second portion of the evaporator is positioned under the plurality of evaporation fins of the evaporator, wherein the capillary tube is positioned at the second portion of the evaporator, and wherein the refrigerant that passes through the first portion of the evaporator is primarily cooled according to a difference in temperature between the refrigerant and the evaporation fins, and the refrigerant that passes through the capillary tube is secondarily cooled by the condensed water falling from the evaporator to the second portion of the evaporator.

2. The laundry machine according to claim 1, wherein the suction duct, the connection duct and the discharge duct are positioned at an upper portion of the tub.

3. The laundry machine according to claim 1, wherein the heat exchanger is a heat pump to dehumidify and heat the air.

4. The laundry machine according to claim 3, wherein condensed water produced by dehumidifying the air in the heat exchanger is discharged from the connection duct.

5. The laundry machine according to claim 1, wherein a part of the refrigerant pipe connecting the condenser and the evaporator is connected to a lower portion of the evaporator.

6. The laundry machine according to claim 1, wherein an area of the condenser is larger than an area of the evaporator.

7. The laundry machine according to claim 1, wherein the heat exchanger further comprises:

a heat dissipation fin comprising an evaporation section to produce condensed water by dehumidifying the air and a condensation section to heat the air having passed through the evaporation section;

an evaporation pipe of the evaporator passing through the evaporation section; and a condensation pipe of the condenser passing through the condensation section.

* * * * *